US009927123B2

(12) United States Patent
Hagan

(10) Patent No.: US 9,927,123 B2
(45) Date of Patent: Mar. 27, 2018

(54) FLUID TRANSPORT SYSTEM HAVING DIVIDED TRANSPORT TUBE

(71) Applicant: United Technologies Corporation, Hartford, CT (US)

(72) Inventor: Benjamin F. Hagan, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 406 days.

(21) Appl. No.: 14/517,962

(22) Filed: Oct. 20, 2014

(65) Prior Publication Data

US 2015/0192072 A1 Jul. 9, 2015

Related U.S. Application Data

(60) Provisional application No. 61/894,983, filed on Oct. 24, 2013.

(51) Int. Cl.
*F23R 3/26* (2006.01)
*F01D 9/06* (2006.01)

(52) U.S. Cl.
CPC ..... *F23R 3/26* (2013.01); *F01D 9/065* (2013.01)

(58) Field of Classification Search
CPC ..... F02C 7/18; F02C 6/08; F02C 9/18; F05D 2260/20; F05D 2260/208; F01D 9/06; F01D 9/065; F01D 25/12; F01D 25/14
See application file for complete search history.

(56) References Cited

U.S. PATENT DOCUMENTS

| | | | | |
|---|---|---|---|---|
| 4,770,608 | A | 9/1988 | Anderson et al. | |
| 5,645,397 | A * | 7/1997 | Soechting | F01D 5/187 415/115 |
| 6,357,999 | B1 | 3/2002 | Pearce et al. | |
| 6,835,046 | B2 * | 12/2004 | Strassberger | F01D 5/187 416/97 R |
| 7,007,488 | B2 * | 3/2006 | Orlando | F01D 9/065 60/782 |
| 7,104,756 | B2 | 9/2006 | Harding et al. | |
| 7,108,479 | B2 * | 9/2006 | Beverley | F01D 5/187 415/115 |
| 8,100,633 | B2 * | 1/2012 | Propheter-Hinckley | F02C 7/18 415/115 |
| 8,152,468 | B2 | 4/2012 | Propheter-Hinckley et al. | |
| 8,353,669 | B2 | 1/2013 | Chon et al. | |
| 8,511,968 | B2 | 8/2013 | Liang et al. | |
| 8,511,969 | B2 | 8/2013 | Durocher et al. | |
| 8,529,195 | B2 * | 9/2013 | Widener | F01D 5/085 415/115 |
| 2006/0093470 | A1 * | 5/2006 | Bermond | F01D 5/147 415/115 |
| 2014/0079540 | A1 * | 3/2014 | Morris | B22F 3/1055 415/178 |

* cited by examiner

*Primary Examiner* — Pascal M Bui Pho
*Assistant Examiner* — Edwin Kang
(74) *Attorney, Agent, or Firm* — Carlson, Gaskey & Olds P.C.

(57) ABSTRACT

A fluid transport system for a gas turbine engine includes a plenum configured to provide a fluid, an airfoil having an internal cavity, and a transfer tube arranged to transfer the fluid between the plenum and the internal cavity of the airfoil. The transfer tube includes an inlet, an outlet, a cavity extending from the inlet to the outlet, and at least one partition wall dividing the cavity into multiple flow passages.

18 Claims, 4 Drawing Sheets

FLUID TRANSPORT SYSTEM HAVING DIVIDED TRANSPORT TUBE

CROSS-REFERENCE TO RELATED APPLICATION

This application claims priority to U.S. Provisional Application No. 61/894,983, filed Oct. 24, 2013.

STATEMENT REGARDING GOVERNMENT SUPPORT

This invention was made with government support under contract number FA8650-09-D-2923 0021 awarded by the United States Air Force. The government has certain rights in the invention.

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Relatively cool air can be bled from the compressor to cool other, relatively warmer components. The bleed air is conveyed through a transport system of interconnected ducts and tubes.

SUMMARY

A fluid transport system for a gas turbine engine according to an example of the present application includes a plenum configured to provide a fluid, an airfoil having an internal cavity, and a transfer tube arranged to transfer the fluid between the plenum and the internal cavity of the airfoil. The transfer tube includes an inlet, an outlet, a cavity extending from the inlet to the outlet, and at least one partition wall dividing the cavity into multiple flow passages.

In a further embodiment of any of the foregoing embodiments, the cavity of the transfer tube follows a curved path between the inlet and the outlet.

In a further embodiment of any of the foregoing embodiments, the inlet and the outlet define non-parallel planes.

In a further embodiment of any of the foregoing embodiments, the inlet has a first opening geometry and the outlet has a second opening geometry that is different than the first opening geometry.

In a further embodiment of any of the foregoing embodiments, each of the multiple flow passages opens at the inlet and at the outlet.

In a further embodiment of any of the foregoing embodiments, the at least one partition wall divides the area of the inlet in to substantially equal inlet sub-areas.

In a further embodiment of any of the foregoing embodiments, the at least one partition wall divides the area of the outlet into substantially equal outlet sub-areas.

In a further embodiment of any of the foregoing embodiments, the at least one partition wall extends partially between the inlet and the outlet.

In a further embodiment of any of the foregoing embodiments, the at least one partition wall is solid and continuous.

A gas turbine engine according to an example of the present disclosure includes a compressor section, a combustor in fluid communication with the compressor section, a turbine section in fluid communication with the combustor, and a fluid transport system configured to transport pressurized fluid from the compressor section. The fluid transport system includes a plenum connected to the compressor section to receive pressurized fluid from the compressor, an airfoil having an internal cavity, and a transfer tube arranged to transfer the pressurized fluid from the plenum into the airfoil. The transfer tube includes an inlet, an outlet, a cavity extending from the inlet to the outlet, and at least one partition wall dividing the cavity into multiple flow passages.

In a further embodiment of any of the foregoing embodiments, the inlet has a first opening geometry and the outlet has a second opening geometry that is different than the first opening geometry.

In a further embodiment of any of the foregoing embodiments, each of the multiple flow passages opens at the inlet and at the outlet.

In a further embodiment of any of the foregoing embodiments, the at least one partition wall is solid and continuous.

In a further embodiment of any of the foregoing embodiments, the transfer tube extends across a secondary plenum.

In a further embodiment of any of the foregoing embodiments, the secondary plenum is at a lower pressure than the plenum and the internal cavity of the airfoil.

A method for managing flow in a fluid transport system for a gas turbine engine includes dividing the cavity of the transfer tube into multiple flow passages to manage flow distribution from the inlet to the outlet.

In a further embodiment of any of the foregoing embodiments, the inlet has a first opening geometry and the outlet has a second opening geometry that is different than the first opening geometry.

In a further embodiment of any of the foregoing embodiments, each of the multiple flow passages opens at the inlet and at the outlet.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
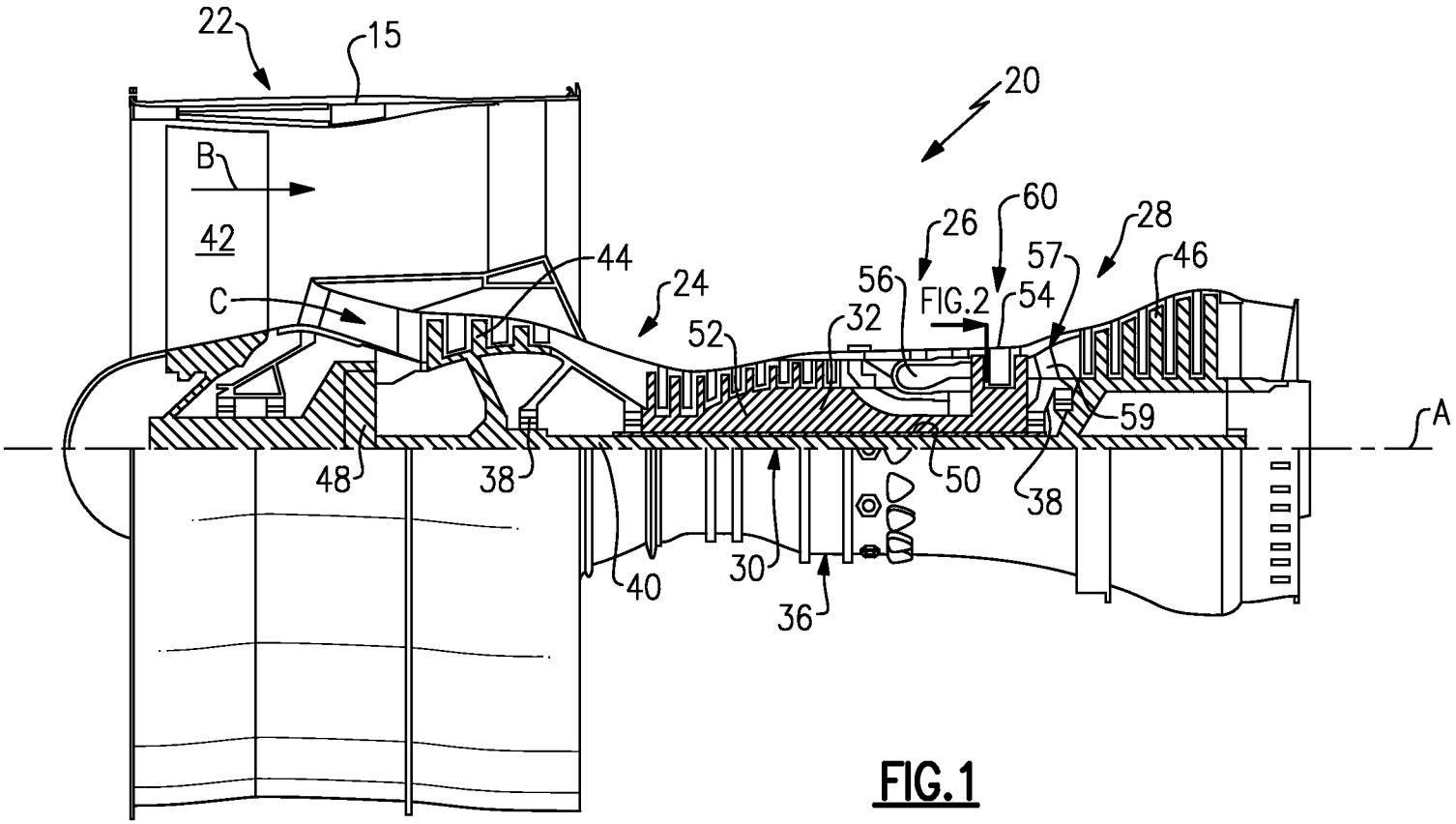
FIG. 1 illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram } °R)/(518.7°R)]^{0.5}$. The "Low corrected fan tip speed" as disclosed herein according to one non-limiting embodiment is less than about 1150 ft/second.

Figure 2:
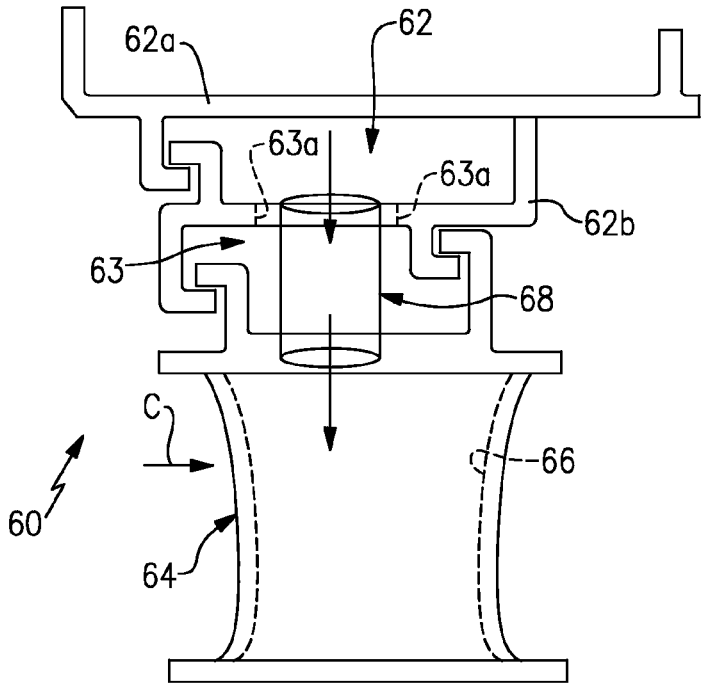
FIG. 2 illustrates an isolated view of an example fluid transfer system of the gas turbine engine of FIG. 1.

The engine 20 also includes a fluid transport system 60 ("system 60") for conveying a cooling fluid in the engine 20. For example, the system 60 is operable to convey relatively cool, pressurized air from the compressor section 24. FIG. 2 shows a sectional view of selected portions of the system 60. The system 60 includes a plenum 62, which extends circumferentially around the engine central axis A and is configured to provide a fluid, an airfoil 64 having an internal cavity 66, and a transfer tube 68 arranged to transfer the fluid between the plenum 62 and the internal cavity 66 of the airfoil 64. A plurality of the transfer tubes 68 can be provided in a circumferential arrangement to be fed from the common plenum 62.

Figure 3:
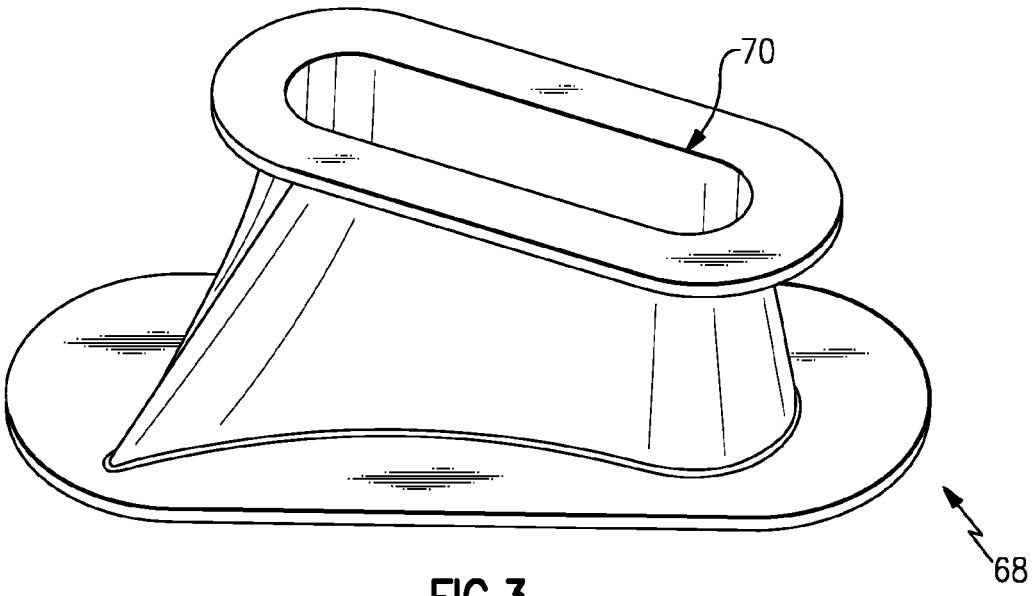
FIG. 3 illustrates an example transfer tube of the fluid transport system of FIG. 2.
Figure 4:
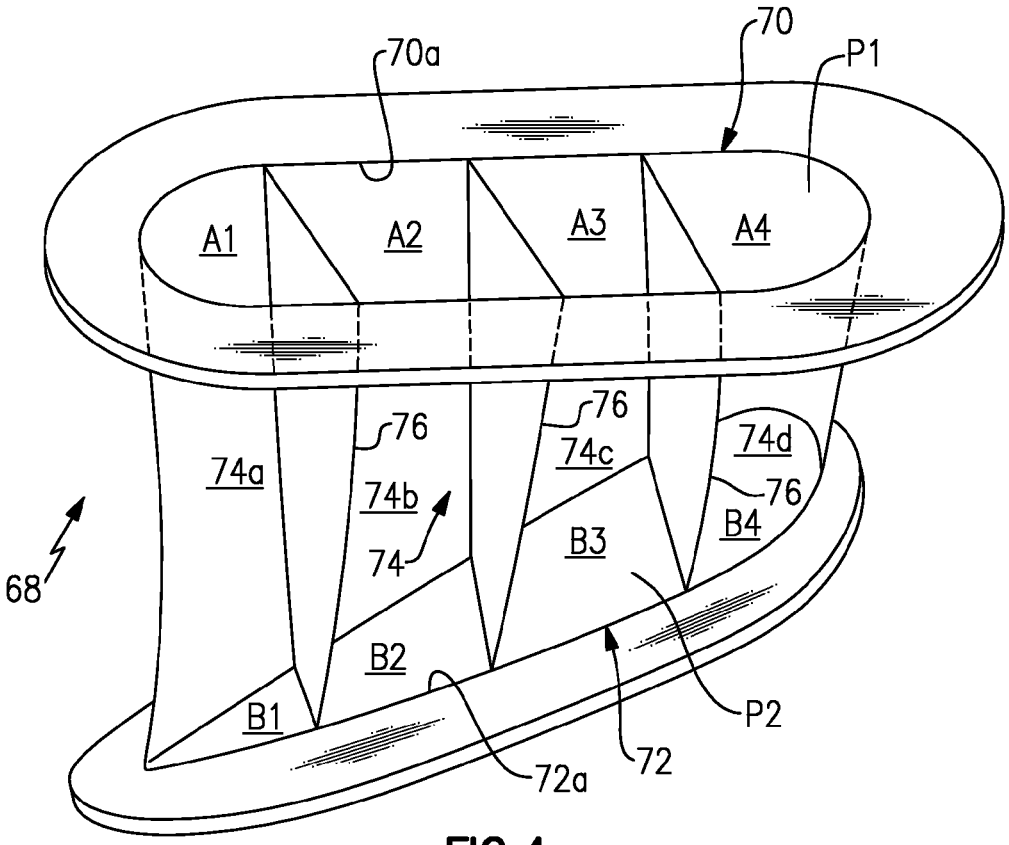
FIG. 4 illustrates the transfer tube of FIG. 3 with the front wall removed to reveal partition walls in a cavity of the transfer tube.

FIG. 3 shows an isolated view of the transfer tube 68, and FIG. 4 shows a view with the front wall made transparent to reveal a cavity 74 within the transfer tube. The transfer tube 68 includes an inlet 70, an outlet 72, the cavity 74 extending from the inlet 70 to the outlet 72, and at least one partition wall 76 dividing the cavity 74 into multiple flow passages, represented in this example at 74*a*, 74*b* 74*c* and 74*d*, extending from the inlet 70 to the outlet 72. For example, the partition wall 76 or walls are solid, continuous walls.

The inlet 70 has a first opening geometry 70*a* and the outlet 72 has a second opening geometry 72*a* that has a different shape than the first opening geometry 70*a*. In this example, the first opening geometry 70*a* is elliptical or pseudo-elliptical and the second opening geometry 72*a* is teardrop-shaped, but the first opening geometry 70*a* and the second opening geometry 72*a* are not limited to these shapes. The first opening geometry 70*a* defines a first plane, P1, and the second opening geometry 72*a* defines a second plane, P2. In this example, the planes P1 and P2 are non-parallel, thus indicating that the internal cavity 66 of the transfer tube 68 follows a curved path (L, FIG. 5) between the inlet 70 and the outlet 72.

Figure 5:
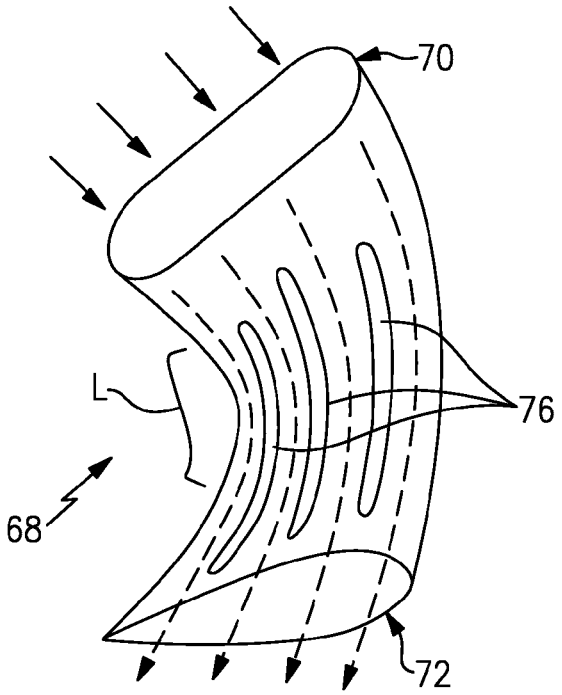
FIG. 5 schematically represents management of flow distribution through the transfer tube.
Figure 6A:
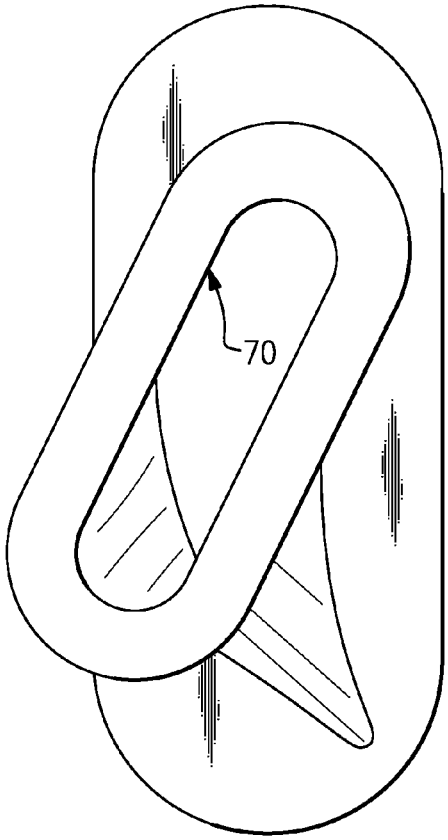
FIG. 6A illustrates an end-on inlet view of a transfer tube.
Figure 6B:
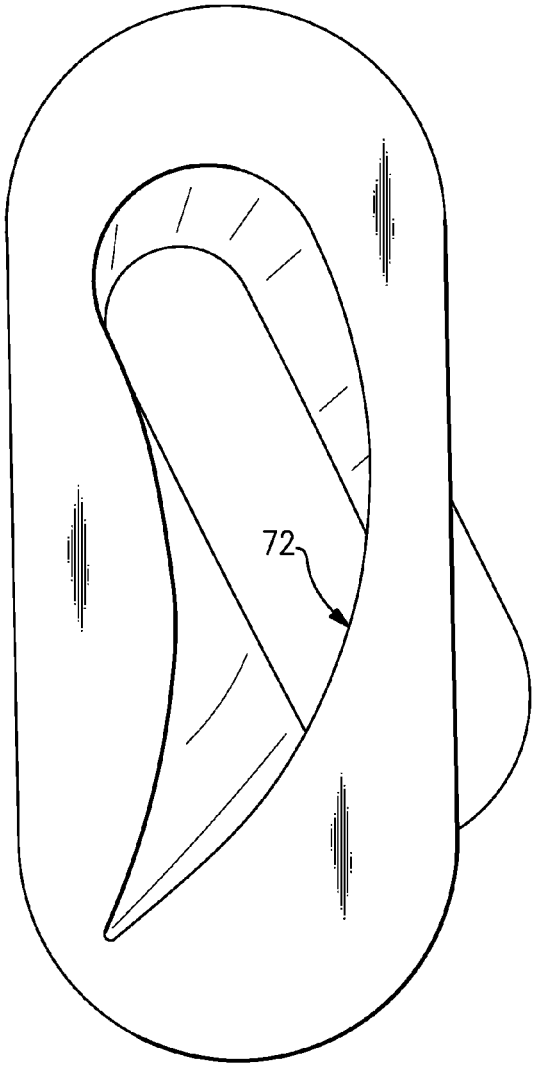
FIG. 6B illustrates an end-on outlet view of the transfer tube of FIG. 6A.

The partition walls 76 and multiple flow passages 74*a*, 74*b* 74*c* and 74*d* facilitate control flow distribution between the different geometries of the openings 70*a*, 72*a*. For example, in the absence of the partition walls, there can be flow stagnation in the cavity 74 as the cavity 74 curves and transitions between the different geometries of the openings 70*a*, 72*a* (see end views of FIGS. 6A and 6B), particularly near the narrow pointed side of the teardrop-shape. Likewise, there would be increased flow at the wide side of the teardrop shape. The local flow stagnation and local flow increase would result in a flow maldistribution through the transfer tube. In comparison, the partition walls 76 mitigate the flow maldistribution by serving as guide baffles to control flow distribution, as schematically represented in FIG. 5. The number, shape and position of the partition walls 76 can be selected according to the geometry of a particular transfer tube and desired flow distribution. For example, although uniform flow distribution may be desired in one implementation, in other implementations a controlled non-uniform flow distribution may be desired to convey more or less flow to particular portions of the internal cavity 66 of the airfoil 64. Similarly, the partition walls 76 can extend fully from opening 70*a* to opening 72*a*, as shown in FIG. 4, or the partition walls 76 can alternatively extend partially between openings 70*a*, 72*a*, as shown for example in FIG. 5. For instance, the partition walls 76 can be utilized through flow-restricted areas to facilitate flow in such areas, while the partition walls 76 may not extend in areas or length of the cavity 74 where less flow guidance is needed. Such areas where flow guidance is needed can include curved lengths of the cavity 74, as represented at L in FIG. 5, or other portions of the cavity 74 that rapidly increase or decrease in cross-section.

In the illustrated example, the partition walls 76 divide the area of the inlet 70 in to substantially equal inlet sub-areas, A1, A2, A3 and A4 (FIG. 4), to split the incoming flow equally. The partition walls 76 can also divide the area of the outlet 72 into substantially equal outlet sub-areas B1, B2, B3 and B4, to distribute the flow evenly in to the internal cavity 66 of the airfoil 64.

In the example shown in FIG. 2, the transfer tube 68 transfers relatively high pressure air from the plenum 62. The plenum 62 is defined by a case 62*a* and a vane support 62*b*. The vane support 62 also defines a secondary plenum 63. The vane support 62*b* includes one or more holes 63*a* that are configured to permit high pressure air from the plenum 62 to flow into the secondary plenum 63 but are small such that the secondary plenum 63 is at a lower air pressure than the air in the plenum 62. The air in the secondary plenum 63 leaks past segment gaps between vane segments to prevent hot gas in the core flow path C from entering the secondary plenum 63. The transfer tube 68 thus spans across the lower pressure, secondary plenum 63 between the higher pressure plenum 62 and the high pressure in the internal cavity 66 of the airfoil 64.

The geometries disclosed herein may be difficult or costly to form using conventional casting technologies. An example method of processing a transfer tube having the features disclosed herein includes an additive manufacturing process. Powdered metal suitable for aerospace applications is fed to a machine, which may provide a vacuum, for example. The machine deposits multiple layers of powdered metal onto one another. The layers are selectively joined to one another with reference to Computer-Aided Design data to form solid structures that relate to a particular cross-section of the transfer tube. In one example, the powdered metal is selectively melted using a direct metal laser sintering process or an electron-beam melting process. Other layers or portions of layers corresponding to negative features, such as cavities or openings, are not joined and thus remain as a powdered metal. The unjoined powder metal may later be removed using blown air, for example. With the layers built upon one another and joined to one another cross-section by cross-section, a transfer tube or portion thereof, such as for a repair, with any or all of the above-described geometries, may be produced. The transfer tube may be post-processed to provide desired structural characteristics. For example, the transfer tube may be heat treated to reconfigure the joined layers into a desired microstructure.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A fluid transport system for a gas turbine engine, comprising:

a plenum configured to provide a fluid;

an airfoil stator having an internal cavity and a radially outer boundary confining a core flow path for combustion gas; and a transfer tube radially outward of the radially outer boundary, the transfer tube arranged to transfer the fluid between the plenum and the internal cavity of the airfoil stator, the transfer tube including an inlet, an outlet having an airfoil shape and extending to the radially outer boundary, a second cavity of the transfer tube extending from the inlet to the outlet, and at least one partition wall dividing the second cavity of the transfer tube into multiple flow passages, the at least one partition wall dividing the inlet into equal inlet sub-areas and dividing the outlet into equal outlet sub-areas.

2. The system as recited in claim 1, wherein the second cavity of the transfer tube follows a curved path between the inlet and the outlet.

3. The system as recited in claim 1, wherein the inlet and the outlet define non-parallel planes.

4. The system as recited in claim 1, wherein the inlet has a first opening geometry and the outlet has a second opening geometry that is different than the first opening geometry.

5. The system as recited in claim 1, wherein each of the multiple flow passages opens at the inlet and at the outlet.

6. The system as recited in claim 1, wherein the at least one partition wall extends partially between the inlet and the outlet.

7. The system as recited in claim 1, wherein the at least one partition wall is solid and continuous.

8. The system as recited in claim 1, wherein the transfer tube is formed of joined powdered metal.

9. The system as recited in claim 1, further comprising a secondary plenum radially inwards of the plenum, and the transfer tube extends from the plenum through the secondary plenum to the internal cavity of the airfoil stator.

10. A gas turbine engine, comprising:

a compressor section;

a combustor in fluid communication with the compressor section;

a turbine section in fluid communication with the combustor; and a fluid transport system configured to transport pressurized fluid from the compressor section, the fluid transport system including:

a plenum connected to the compressor section to receive pressurized fluid from the compressor section, a secondary plenum radially inwards of the plenum;

an airfoil stator having an internal cavity and a radially outer boundary confining a core flow path for combustion gas, and a transfer tube radially outward of the radially outer boundary, the transfer tube extends from the plenum through the secondary plenum to the internal cavity of the airfoil stator, the transfer tube arranged to transfer the pressurized fluid from the plenum into the airfoil stator, the transfer tube including an inlet, an outlet having an airfoil shape and that extends to the radially outer boundary, a second cavity of the transfer tube extending from the inlet to the outlet, and at least one partition wall dividing the second cavity of the transfer tube into multiple flow passages, the at least one partition wall dividing the inlet into equal inlet sub-areas and dividing the outlet into equal outlet sub-areas.

11. The gas turbine engine as recited in claim 10, wherein the inlet has a first opening geometry and the outlet has a second opening geometry that is different than the first opening geometry.

12. The gas turbine engine as recited in claim 10, wherein each of the multiple flow passages opens at the inlet and at the outlet.

13. The gas turbine engine as recited in claim 10, wherein the at least one partition wall is solid and continuous.

14. The gas turbine engine as recited in claim 10, wherein the secondary plenum is at a lower pressure than the plenum and the internal cavity of the airfoil stator.

15. The gas turbine engine as recited in claim 10, further comprising holes connecting the plenum and the secondary plenum such that the pressurized fluid can flow from the plenum to the secondary plenum.

16. The system as recited in claim 9, further comprising holes connecting the plenum and the secondary plenum such that the fluid can flow from the plenum to the secondary plenum.

17. The system as recited in claim 9, wherein the second cavity of the transfer tube follows a curved path between the inlet and the outlet, and the inlet and the outlet define non-parallel planes.

18. The gas turbine engine as recited in claim 15, wherein the second cavity of the transfer tube follows a curved path between the inlet and the outlet, and the inlet and the outlet define non-parallel planes.

* * * * *